US010760356B2

(12) United States Patent
Meeks

(10) Patent No.: US 10,760,356 B2
(45) Date of Patent: Sep. 1, 2020

(54) DRILL PIPE GUIDE SYSTEM AND METHOD

(71) Applicant: Nabors Drilling Technologies USA, Inc., Houston, TX (US)

(72) Inventor: Nicholas Paul Meeks, Katy, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 240 days.

(21) Appl. No.: 15/170,757

(22) Filed: Jun. 1, 2016

(65) Prior Publication Data

US 2016/0356102 A1 Dec. 8, 2016

Related U.S. Application Data

(60) Provisional application No. 62/171,151, filed on Jun. 4, 2015.

(51) Int. Cl.

| | |
|---|---|
| ***E21B 19/087*** | (2006.01) |
| ***E21B 19/24*** | (2006.01) |
| ***E21B 19/084*** | (2006.01) |
| ***E21B 19/16*** | (2006.01) |
| ***E21B 19/09*** | (2006.01) |
| ***E21B 19/10*** | (2006.01) |

(52) U.S. Cl.

CPC ..... *E21B 19/087* (2013.01); *E21B 19/084* (2013.01); *E21B 19/09* (2013.01); *E21B 19/10* (2013.01); *E21B 19/16* (2013.01); *E21B 19/165* (2013.01); *E21B 19/24* (2013.01)

(58) Field of Classification Search

CPC ..... E21B 19/084; E21B 19/087; E21B 19/09; E21B 19/10; E21B 19/16; E21B 19/165; E21B 19/24

See application file for complete search history.

(56) References Cited

U.S. PATENT DOCUMENTS 3,835,939 A * 9/1974 McEntire ..... E21B 17/10 175/65
3,874,518 A 4/1975 Swoboda, Jr. et al.
4,202,653 A * 5/1980 Moller ..... B65G 1/0442 414/22.57

(Continued)

FOREIGN PATENT DOCUMENTS

DE 19814033 10/1999
DE 19814033 A1 * 10/1999 ..... E21B 7/20

OTHER PUBLICATIONS

Hermes et al., DE 19814033 A1., Machine Translation dated Mar. 23, 2018. (Year: 1999).*

(Continued)

*Primary Examiner* — Caroline N Butcher
(74) *Attorney, Agent, or Firm* — Abel Schillinger, LLP; Enrique Abarca

(57) ABSTRACT

A drill pipe guide system having a support structure configured to be positioned on a rig floor or drillship floor, an articulating arm coupled to the support structure, wherein the articulating arm is coupled to the support structure, wherein the articulating arm is configured to pivot relative to the support structure, and a clamp coupled to the articulating arm, wherein the clamp is configured to encircle a drill string and limit radial movement of the drill string as the drill string is lowered beneath the rig floor or drillship floor.

20 Claims, 9 Drawing Sheets

(56) References Cited

U.S. PATENT DOCUMENTS

| | | | | |
|---|---|---|---|---|
| 4,274,778 | A * | 6/1981 | Putnam | B25J 9/0084 175/85 |
| 5,609,457 | A * | 3/1997 | Burns | E21B 19/24 175/85 |
| 7,104,316 | B1 * | 9/2006 | Hobgood | E21B 19/165 166/117.5 |
| 2003/0221519 | A1 | 12/2003 | Haugen | |
| 2008/0308281 | A1 | 12/2008 | Boutwell, Jr. et al. | |

OTHER PUBLICATIONS

PCT/US2016/035539 International Search Report and Written Opinion dated Sep. 1, 2016.

* cited by examiner

DRILL PIPE GUIDE SYSTEM AND METHOD

CROSS REFERENCE TO RELATED APPLICATION

This application claims the benefit of U.S. Provisional Application No. 62/171,151, entitled "DRILL PIPE GUIDE SYSTEM AND METHOD," filed Jun. 4, 2015, which is hereby incorporated by reference in its entirety.

BACKGROUND

Present embodiments relate generally to the field of drilling and processing of wells, and, more particularly, to a drill pipe system and method for guiding a drill pipe into a wellbore.

In conventional oil and gas operations, a drilling rig is used to drill a wellbore to a desired depth using a drill string, which includes drillpipe, drill collars and a bottom hole drilling assembly. During drilling, the drill string may be turned by a rotary table and kelly assembly or by a top drive to facilitate the act of drilling. As the drill string progresses down hole, additional drillpipe is added to the drill string.

During drilling of the well, the drilling rig may be used to insert joints or stands (e.g., multiple coupled joints) of drillpipe into the wellbore (e.g., a surface wellbore or a subsea wellbore). Similarly, the drilling rig may be used to remove drillpipe from the wellbore. As an example, during insertion of drillpipe into the wellbore by a traditional operation, each drillpipe element (e.g., each joint or stand) is coupled to an attachment feature that is in turn lifted by a traveling block of the drilling rig such that the drillpipe element is positioned over the wellbore or over a subsea wellhead beneath an offshore drilling rig or ship. An initial drillpipe element may be positioned in the wellbore or sea and held in place by gripping devices near the rig floor, such as slips. Subsequent drillpipe elements may then be coupled to the existing drillpipe elements in the wellbore or sea to continue formation of the drill string. Once attached, the drillpipe element and remaining drill string may be held in place by an elevator and released from the gripping devices (e.g., slips) such that the drill string can be lowered into the wellbore or towards subsea equipment at the sea floor. As the drill string is lowered into the wellbore or sea, umbilical cables or lines may be positioned adjacent to the drill string and clamped to the drill string. The umbilical cables or lines supply various supplies, such as air pressure, electrical power, hydraulic power, fiber optics, or other supplies to components within the wellbore and/or subsea components.

BRIEF DESCRIPTION

In accordance with one aspect of the disclosure, a drill pipe guide system includes a support structure configured to be positioned on a rig floor, an articulating arm coupled to the support structure, wherein the articulating arm is configured to pivot relative to the support structure, and a clamp coupled to the articulating arm, wherein the clamp is configured to encircle a drill string and limit radial movement of the drill string as the drill string is lowered beneath the rig floor.

In accordance with another aspect of the disclosure, a method includes coupling a tubular to a drill string to be run into a wellbore with a tubular rotation system, positioning an umbilical cable against the drill string with an umbilical guide system, encircling the drill string with a clamp of a drill pipe guide system, and running the drill string through slips in a drilling rig floor, wherein the clamp of the drill pipe guide system comprises an inner diameter that is less than an inner diameter of the slips in the drilling rig floor.

In accordance with another aspect of the disclosure, a system includes a support structure configured to be positioned on a drillship floor, wherein the support structure comprises a base, a plurality of lateral sides extending from the base, an articulating arm coupled to the support structure, wherein the articulating arm is configured to pivot relative to the support structure, and a clamp disposed at a distal end of the articulating arm, wherein the clamp is configured to be disposed about a drill string and limit radial movement of the drill string as the drill string is lowered beneath the drillship floor.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Present embodiments are directed to a system and method for guiding a drill string and/or drill pipe elements into a wellbore and/or into a sea or ocean towards subsea equipment. As mentioned above, drill pipe elements are joined to one another to form a drill string and are lowered into a wellbore or into the sea or ocean towards subsea equipment at the sea floor. As the drill string is assembled and lowered, umbilical lines or cables may be added to the drill string and clamped thereto. As the drill string and umbilical cables are lowered, the drill string passes through slips on a floor of the drilling rig that may hold the drill string in place when the slips are actuated. In certain embodiments, a passage of the slips through which the drill string passes may have an inner diameter that is relatively large compared to an outer diameter of the drill string (e.g., to permit passage of clamps for umbilical lines), thereby enabling undesired movement of the drill string (e.g., within the slips, wellbore, and/or ocean). Thus, present embodiments include a drill pipe guide system (e.g., drill string guide system) configured to limit movement (e.g., radial movement) of the drill string as drill pipe elements and umbilical cables are added to the drill string and the drill string is lowered into the ocean or into a wellbore. More specifically, the drill pipe guide system is a floor-mounted or modular system with an articulating arm having a clamp or guide hand that is positioned about the drill string. The clamp has an inner diameter that is generally smaller than an inner diameter of the passage of the slips through which the drill string passes. Thus, the clamp limits the movement (e.g., radial movement) of the drill string as umbilicals are added to the drill string and as the drill string is lowered into the ocean or wellbore.

The floor-mounted configuration of the drill pipe guide system enables modularity and portability of the drill pipe guide system. For example, the drill pipe guide system may not require mounting to a derrick or other component of a drilling rig or ship. Additionally, the portability of the floor-mounted drill pipe guide system may enable the drill pipe guide system to be positioned at any location about the circumference of the drill string or slips. In other words, the drill pipe guide system may be positioned anywhere on a rig floor, thereby increasing convenience and flexibility when using the drill pipe guide system. When the drill pipe guide system is not in use, the drill pipe guide system may readily be positioned away from the slips and drill string for storage until the drill pipe guide system is used again.

Figure 1:
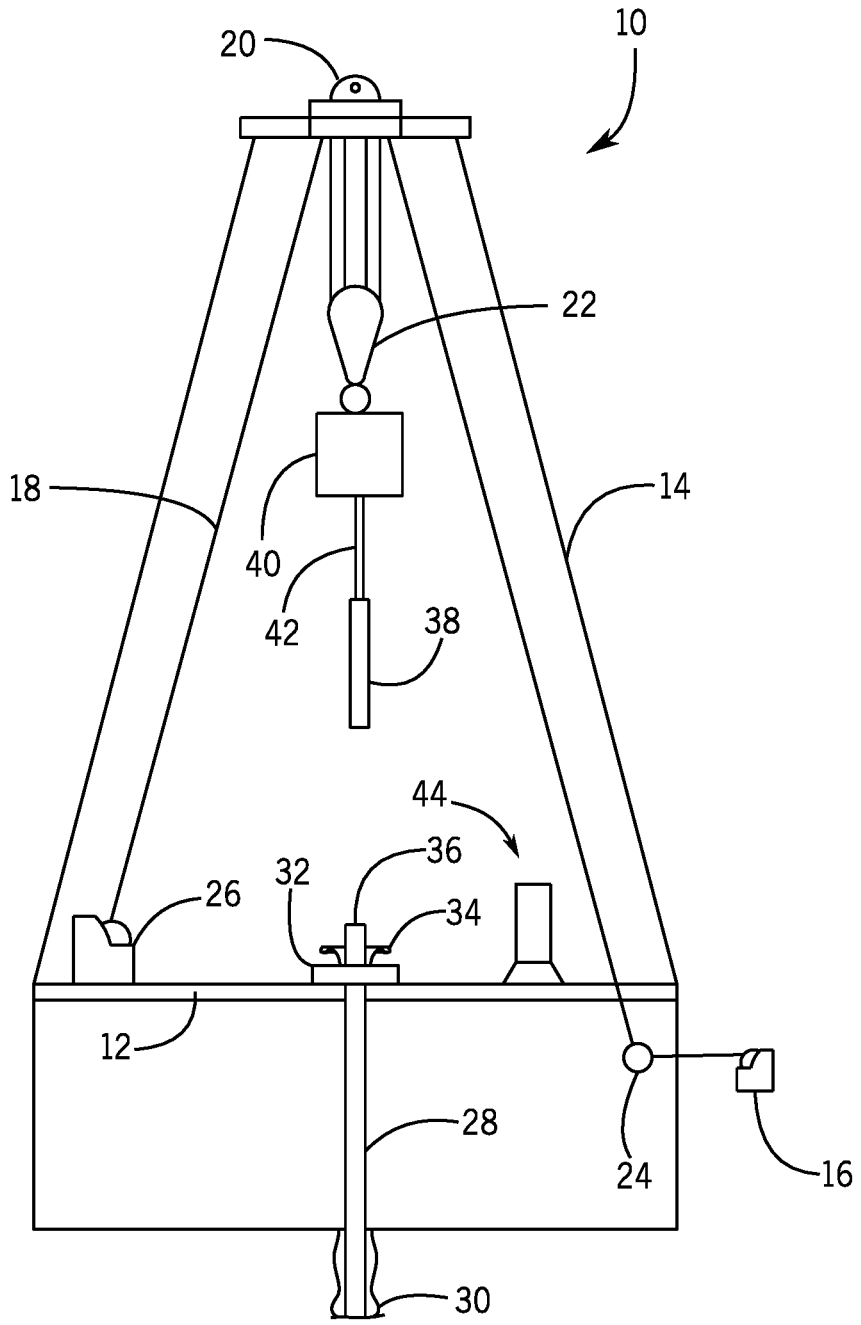
FIG. 1 is a schematic of a well being drilled, in accordance with an embodiment of the present disclosure.

Turning now to the drawings, FIG. 1 is a schematic of a drilling rig 10 in the process of drilling a well in accordance with present techniques. The drilling rig 10 features a rig floor 12 and a derrick 14 extending above the rig floor 12 (e.g., a drill ship floor). The drilling rig 10 may be land-based or sea-based. For example, the drilling rig 10 may be placed on a ground surface or may be part of a floating platform or drill ship. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 (or ocean above the wellbore 30) and is held stationary with respect to the rig floor 12 by a rotary table 32 and slips 34. In certain embodiments, the rotary table 32 and/or the slips 34 may be flush-mounted in the rig floor 12. A portion of the drill string 28 extends above the rig floor 12, forming a stump 36 to which another length of tubular 38 may be added. A top drive 40 (e.g., tubular rotation system), hoisted by the traveling block 22, positions the tubular 38 above the wellbore before coupling with the tubular 38. The top drive 40, once coupled with the tubular 38, may then lower the coupled tubular 38 toward the stump 36 and rotate the tubular 38 such that it connects with the stump 36 and becomes part of the drill string 28. Specifically, the top drive 40 includes a quill 42 used to turn the tubular 38 or other drilling equipment.

FIG. 1 further illustrates a drill pipe guide system 44 positioned on the rig floor 12. As mentioned above, the drill pipe guide system 44 is configured to limit movement (e.g., radial movement) of the drill string 28 as tubulars 38 and umbilical cables are added to the drill string 28 and the drill string 28 is lowered into the ocean and/or into the wellbore 30. As shown, the drill pipe guide system 44 is a floor-mounted or modular system that is positioned on the rig floor 12. In the illustrated embodiment, the drill pipe guide system 44 is shown off to the side away from the rotary table 32, slips 34, and drill string 28. However, the drill pipe guide system 44 may be positioned adjacent to the rotary table 32 and slips 34 when use of the drill pipe guide system 44 is desired. Operation of the drill pipe guide system 44 is described in further detail below.

It should be noted that the illustration of FIG. 1 is intentionally simplified to focus on the drill pipe guide system 44 that is described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
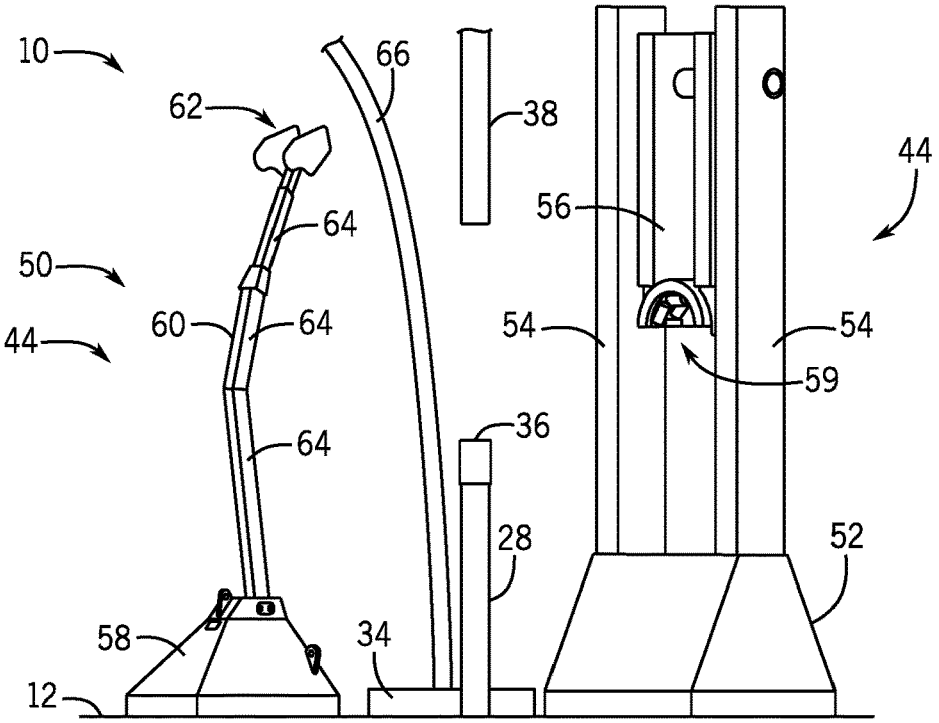
FIG. 2 is a perspective view of an embodiment of a drill pipe guide system and an umbilical guide system for use in assembling and lowering a drill string, in accordance with an embodiment of the present disclosure.

FIG. 2 is a perspective side view of the drill pipe guide system 44 positioned on the rig floor 12 adjacent to the slips 34 and the drill string 28. The drill pipe guide system 44 also includes an umbilical guide system 50 positioned on the rig floor 12 adjacent to the slips 34 and the drill string 28. In the illustrated embodiment, the drill pipe guide system 44 includes a base 52, support arms 54, and an articulating arm 56. The articulating arm 56 is shown in a retracted position. As discussed below, the articulating arm 56 is configured to extend from the support arms 54 to enable guiding of the drill string 28 into the wellbore 30, which may be underwater. Specifically, a clamp 59 of the drill pipe guide system 44 is disposed at a distal end of the articulating arm 56, and the clamp 59 is configured to be disposed about and/or partially/fully encircle the drill string 28 as the drill string 28 is lowered into the ocean and/or wellbore 30. The clamp 59 has an internal diameter that is less than an internal diameter of the slips 34, which enables the clamp 59 to restrict radial movement of the drill string 28 as the drill string 28 is lowered through the slips 34.

The umbilical guide system 50 is also shown in a retracted position. The umbilical guide system 50 includes a base 58, an extension arm 60, and a guide bracket 62 disposed at a distal end of the extension arm 60. The extension arm 60 may include one or more linkages 64 configured to pivot and/or extend relative to the base 58 and one another to enable guidance of one or more umbilical cables 66 against the drill string 28. As mentioned above, both the drill pipe guide system 44 and the umbilical guide system 50 are floor mounted systems positioned adjacent to the drill string 28. In other words, drill pipe guide system 44 and the umbilical guide system 50 each sit on the rig floor 12 adjacent to the drill string 28 being assembled and are not mounted to another component of the drilling rig 10 (e.g., the derrick 14). However, it should be noted that the drill pipe guide system 44 and/or the umbilical guide system 50 may include a base plate configured to engage other equipment, such as a drilling rig platform, a flush mounted slip or spider system (e.g., slips 34), or other component on the drilling rig floor 12 (e.g., drill ship floor). Additionally, in the illustrated embodiment, the drill pipe guide system 44 and the umbilical guide system 50 are separate systems. However, in other embodiments, the drill pipe guide system 44 and the umbilical guide system 50 may be integrated with one another to form a single system.

Figure 3:
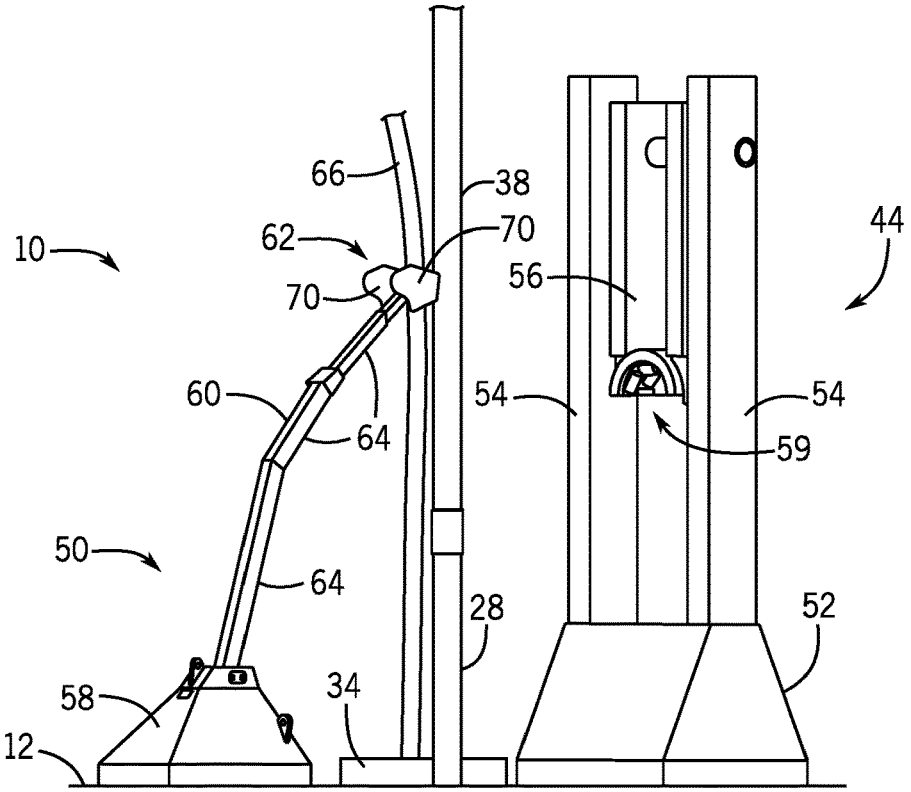
FIG. 3 is a perspective view of an embodiment of a drill pipe guide system and an umbilical guide system for use in assembling and lowering a drill string, in accordance with an embodiment of the present disclosure.

FIG. 3 is a perspective side view of the drill pipe guide system 44 and the umbilical guide system 50 positioned on the rig floor 12, illustrating the umbilical guide system 50 guiding and positioning umbilical cables 66 adjacent to the tubular 38 that has been added to the drill string 28. The articulating arm 56 of the drill pipe guide system 44 is still in a retracted position. To guide and position the umbilical cables 66 adjacent to the tubular 38 and the drill string 28, the extension arm 60 of the umbilical guide system 50 may be actuated to pivot relative to the base 58 and capture the umbilical cables 66. Specifically, the extension arm 60 may be articulated such that side flanges 70 of the guide bracket 62 are disposed on either side of the umbilical cables 66. With the umbilical cables 66 disposed between the side flanges 70, the extension arm 60 may be further actuated to push the umbilical cables 66 against the drill string 28. Once the umbilical cables 66 are positioned adjacent to the drill string 28, the umbilical cables 66 may be clamped to the drill string 28 to secure the umbilical cables 66 and limit movement of the umbilical cables 66 relative to the drill string 28 as the drill string 28 is lowered into the wellbore 30 and/or ocean.

Figure 4:
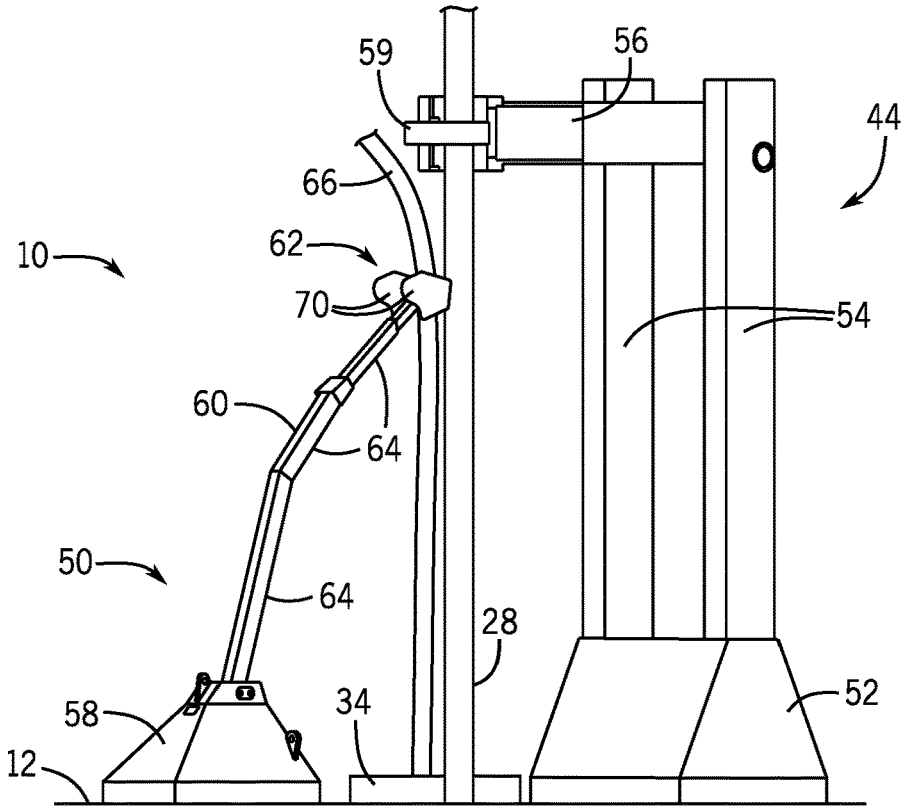
FIG. 4 is a perspective view of an embodiment of a drill pipe guide system and an umbilical guide system for use in assembling and lowering a drill string, in accordance with an embodiment of the present disclosure.

FIG. 4 is a perspective side view of the drill pipe guide system 44 and the umbilical guide system 50 positioned on the rig floor 12, illustrating the articulating arm 56 of the drill pipe guide system 44 in a deployed or extended position. The articulating arm 56 may be deployed from the support arms 54 by pivoting relative to the support arms 54, extending (e.g., telescoping) from the support arms 54, or another mechanism. Additionally, in the illustrated embodiment, the clamp 59 disposed at the distal end of the articulating arm 56 is positioned about the drill string 28. In other embodiments, the articulating arm 56 and clamp 59 of the drill pipe guide system 44 may be deployed before the umbilical cables 66 are positioned adjacent to the drill string 28 and/or clamped to the drill string 28. In some embodiments, the umbilical cables 66 may be positioned and clamped to the drill string 28 while the articulating arm 56 and clamp 59 of the drill pipe guide system 44 are simultaneously deployed. With the articulating arm 56 of the drill pipe guide system 44 deployed and the clamp 59 positioned about the drill string 28, the drill string 28 may be further lowered into the wellbore 30 and/or ocean, and the clamp 59 of the drill pipe guide system 44 may limit radial movement of the drill string 28. In some embodiments, the umbilical guide system 50 may be retracted before the drill string 28 is lowered. Once the drill string 28 is lowered a desired amount, the clamp 59 may be released, and the articulating arm 56 may be retracted to enable coupling of another tubular 38 to the drill string 28.

Figure 5:
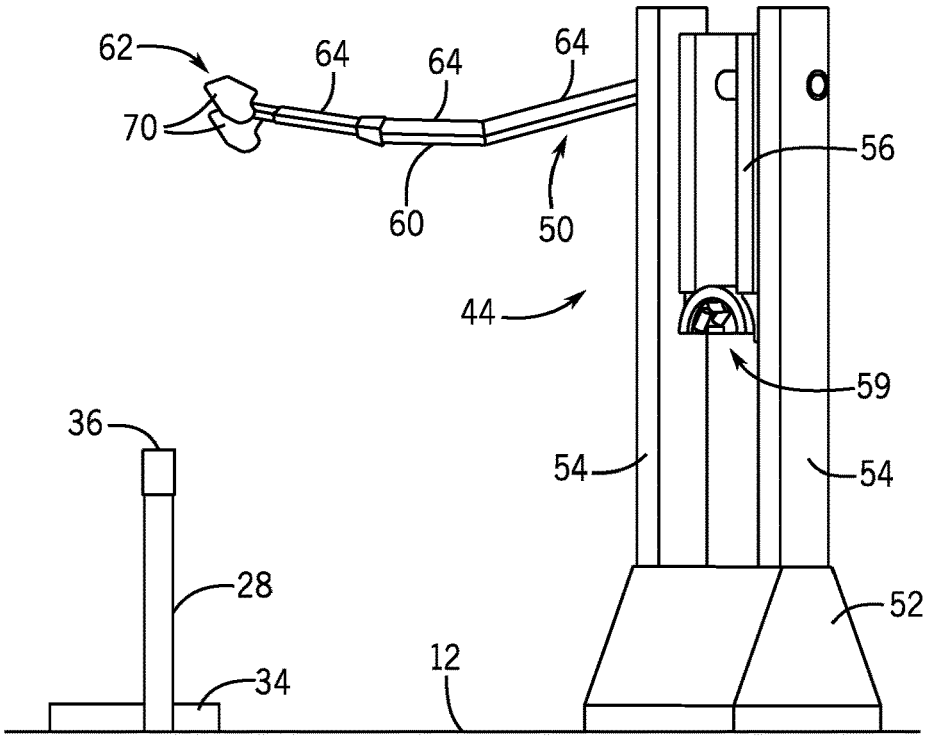
FIG. 5 is a perspective view of an embodiment of a drill pipe guide system and an umbilical guide system for use in assembling and lowering a drill string, in accordance with an embodiment of the present disclosure.

In some embodiments, the umbilical guide system 50 may be a component of the floor-mounted drill pipe guide system 44. For example, as shown in FIG. 5, the drill pipe guide system 44 includes the base 52 that sits on the rig floor 12, the support arms 54 extend from the base 52, and both the articulating arm 56 and the extension arm 60 of the umbilical guide system 50 are coupled to the support arms 54. However, other embodiments and configurations are contemplated and fall within the scope of the present disclosure.

Figure 6:
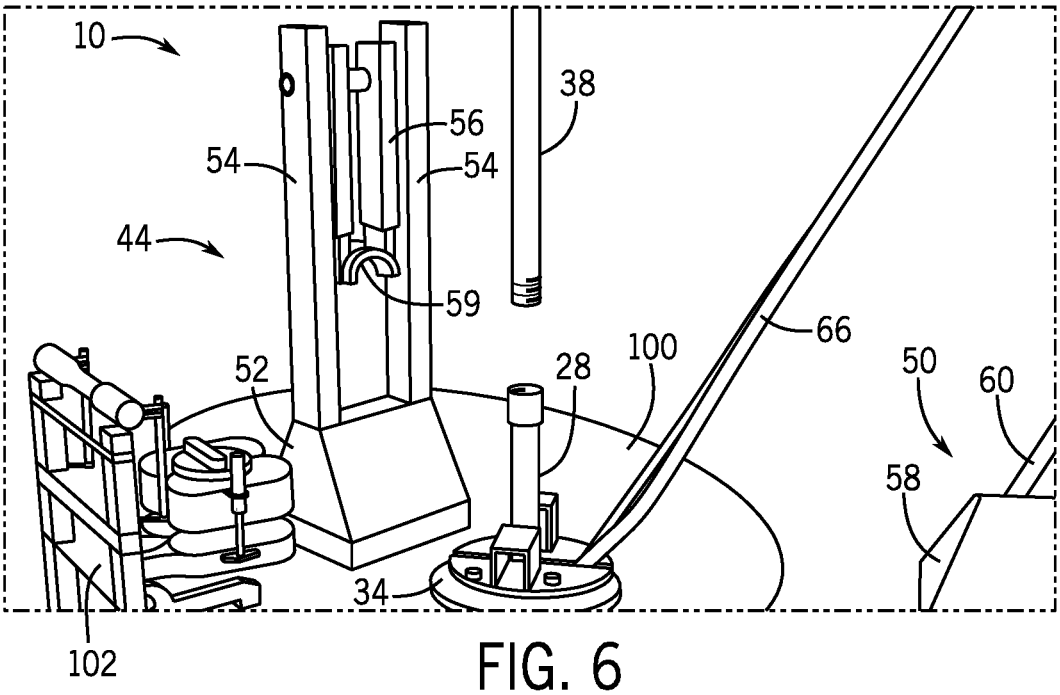
FIG. 6 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.

FIG. 6 is a perspective view of the drill pipe guide system 44 that may be used during assembling and lowering of the drill string 28 into the wellbore 30 and/or towards subsea equipment at a sea floor. As shown, the tubular 38 is being lowered towards the drill string 28 that is held in place within the wellbore 30 or within the ocean by the slips 34 (e.g., flush mounted slips). The drill pipe guide system 44 and the umbilical guide system 50 are shown in retracted positions. Additionally, in the illustrated embodiment, the drill pipe guide system 44 is shown mounted on an outer ring 100 of the flush mounted slips 34 on the rig floor 12 of the drilling rig 10 (e.g., drill ship). In certain embodiments, the outer ring 100 may be rotatable about the flush mounted slips 34, and the outer ring 100 may have mounts that secure the drill pipe guide system 44 and/or the umbilical guide system 50 to the floor 12 of the drilling rig 10 or ship. In certain embodiments, the base 52 of the drill pipe guide system 44 may have a plate or other mount that has a curved surface configured to engage, mate, or mount to the outer ring 100 of the flush mounted slips 34.

Figure 7:
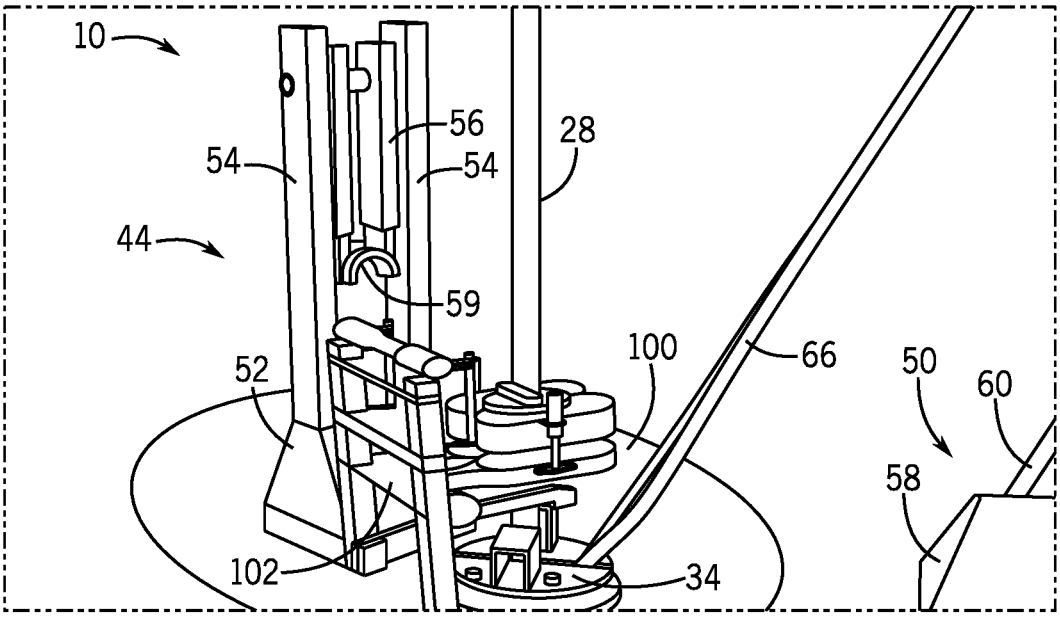
FIG. 7 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.

After the tubular 38 is lowered to the drill string 28 (e.g., to the stump 36 of the drill string 28), the tubular 38 may be joined (e.g., threaded) to the drill string 28. For example, FIG. 7 is a perspective view of the drilling rig 10, illustrating a pipe joint system 102 that may be used to join (e.g., thread) the tubular 38 to the drill string 28. For example, the pipe joint system 102 may rotate the tubular 38 or the drill string 28 to thread the tubular 38 to the drill string 28. In the illustrated embodiment, the drill pipe guide system 44 and the umbilical guide system 50 are still in retracted positions.

Figure 8:
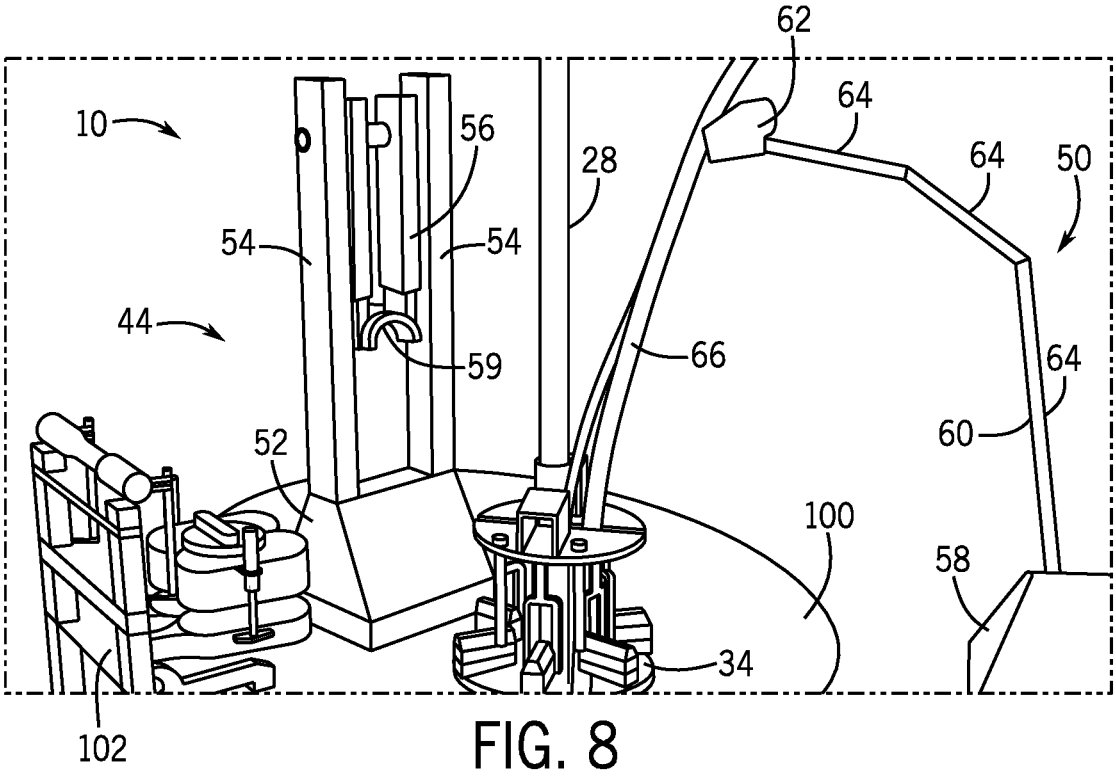
FIG. 8 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.

Once the tubular 38 is added to the drill string 28, the pipe joint system 102 may retract. Thereafter, the umbilical guide system 50 may be used to guide the umbilical cables 66 toward and against the drill string 28 with the recently-added tubular 38. For example, FIG. 8 is a perspective view of the drilling rig 10, illustrating the umbilical guide system 50 guiding the umbilical cables 66 toward the drill string 28. As described above, the guide bracket 62 disposed at the distal end of the extension arm 60 may capture the umbilical cables 66 to direct the umbilical cables 66 to be adjacent to the drill string 28. In particular, the linkages 64 of the extension arm 60 may be manipulated or controlled to position the guide bracket 62 adjacent to the umbilical cables 66, such that the umbilical cables 66 are positioned between the side flanges 70 of the guide bracket 62.

Figure 9:
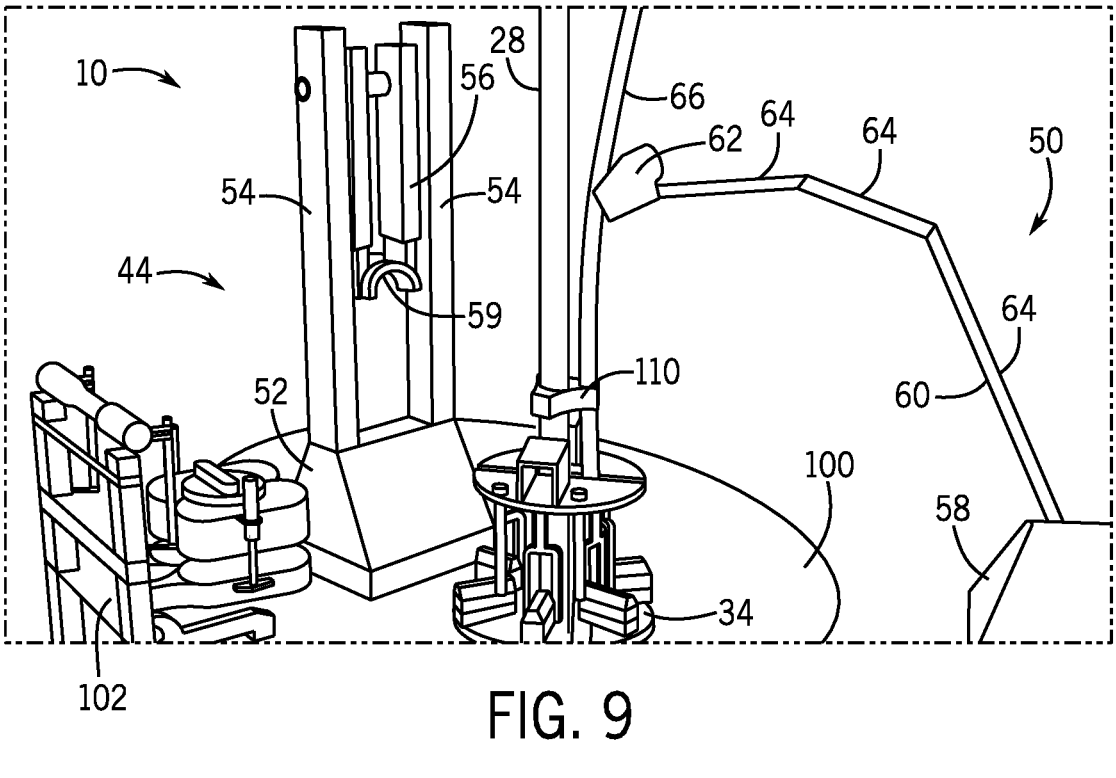
FIG. 9 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.

Once the umbilical cables 66 are positioned adjacent to the drill string 28, the umbilical cables 66 are clamped to the drill string 28. For example, FIG. 9 is a perspective view of the umbilical cables 66 clamped to the drill string 28 with an umbilical clamp 110. The umbilical guide system 50 may hold the umbilical cables 66 against or adjacent to the drill string 28 until the umbilical clamp 110 is coupled to the drill string 28 to secure the umbilical cables 66 to the drill string 28. In certain embodiments, the umbilical guide clamp 110 may be manually coupled to the drill string 28 to secure the umbilical cables 66 to the drill string 28. In other embodiments, the umbilical guide system 50 may be configured to apply the guide clamp 110 to the drill string 28. For example, the guide bracket 62 may be configured to carry the guide clamp 110 and couple the guide clamp 110 to the drill string 28.

Figure 10:
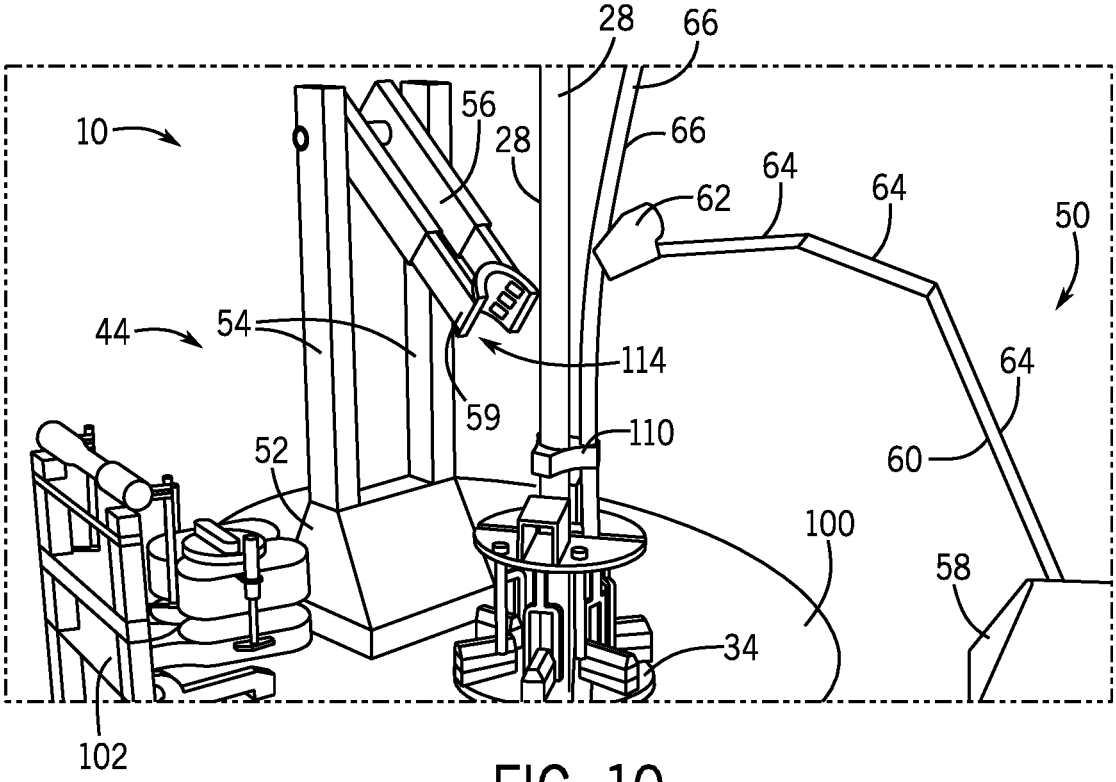
FIG. 10 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.

With the umbilical cables 66 clamped and secured to the drill string 28, the drill pipe guide system 44 may be deployed and clamped to and/or disposed about the drill string 28 (e.g., drill pipe). In particular, the drill pipe guide system 44 is deployed and clamped to the drill string 28 prior to the drill string 28 being lowered into the wellbore 30 and/or into the ocean. FIG. 10 is a perspective view of the drilling rig 10, illustrating the articulating arm 56 in a partially deployed position. In the illustrated embodiment, the articulating arm 56 rotates or pivots relative to the support arms 54 of the drill pipe guide system 44 from a retracted position to a deployed position. In certain embodiments, the articulating arm 56 may additionally or alternatively include a telescoping configuration. For example, after the articulating arm 56 may pivot from a retracted position to a deployed position, the articulating arm 56 may telescope or extend outwards, such that the clamp 59 of the articulating arm 56 is positioned adjacent to the drill string 28. In particular, the clamp 59 may be positioned adjacent to the drill string 28 but above umbilical clamp 110 and/or above or before abutment of the umbilical cables 66 against the drill string 28. Additionally, in the position shown in FIG. 10, the clamp 59 has an opening 114 configured to receive the drill string 28.

Figure 11:
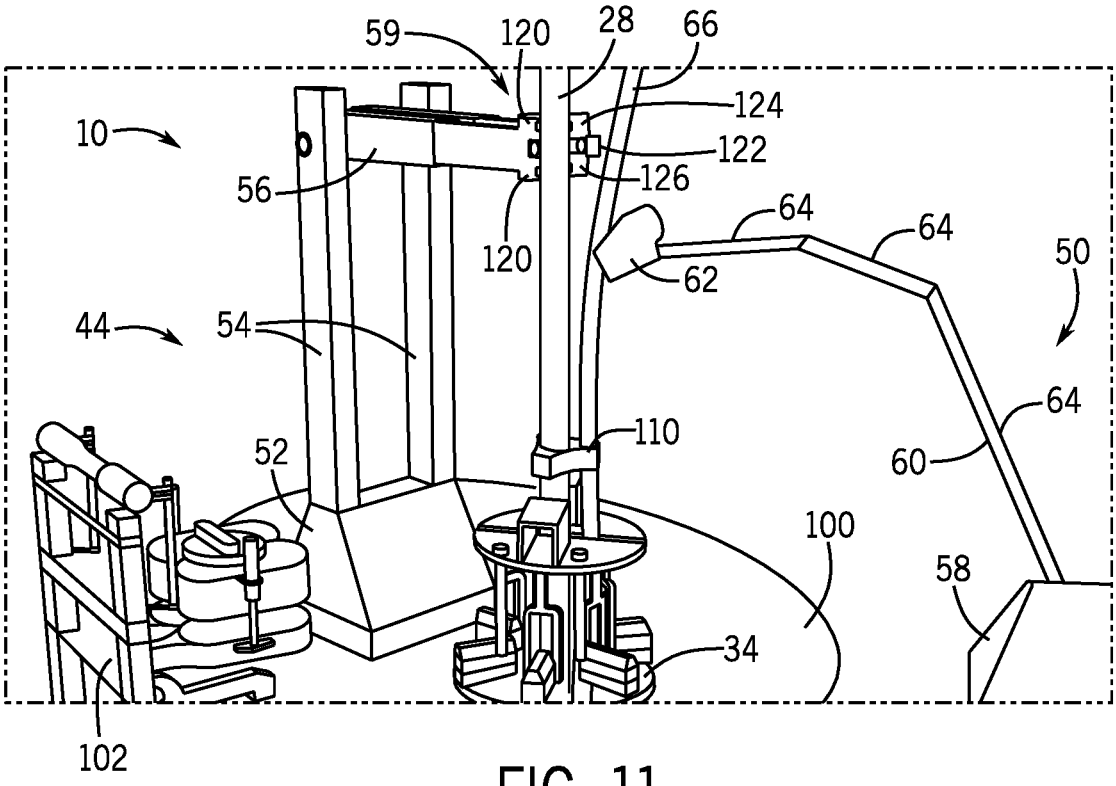
FIG. 11 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.

FIG. 11 is a perspective view of the drilling rig 10, illustrating the drill pipe guide system 44 with the clamp 59 in a partially actuated position. In the illustrated embodiment, the clamp 59 has an outer housing 120 and an inner ring 122 (e.g., inner arc) or arcuate member. To position the clamp 59 about the drill string 28, the inner ring 122 or arcuate member may be rotated relative to the outer housing 120 of the clamp 59. For example, the outer housing 120 and the inner ring 122 may have gears, bearings, pistons, and/or other mechanisms to enable relative rotation of the outer housing 120 and inner ring 122. In the illustrated embodiment, the outer housing 120 has an upper portion 124 and a lower portion 126. The inner ring 122 of the clamp 59 is disposed axially between the upper portion 124 and the lower portion 126. However, in other embodiments, the outer housing 120 and the inner ring 122 may have other configurations. For example, the inner ring 122 may include two or more arcuate segments configured to rotate relative to the outer housing 100 to cooperatively encircle or capture the drill string 28.

Figure 12:
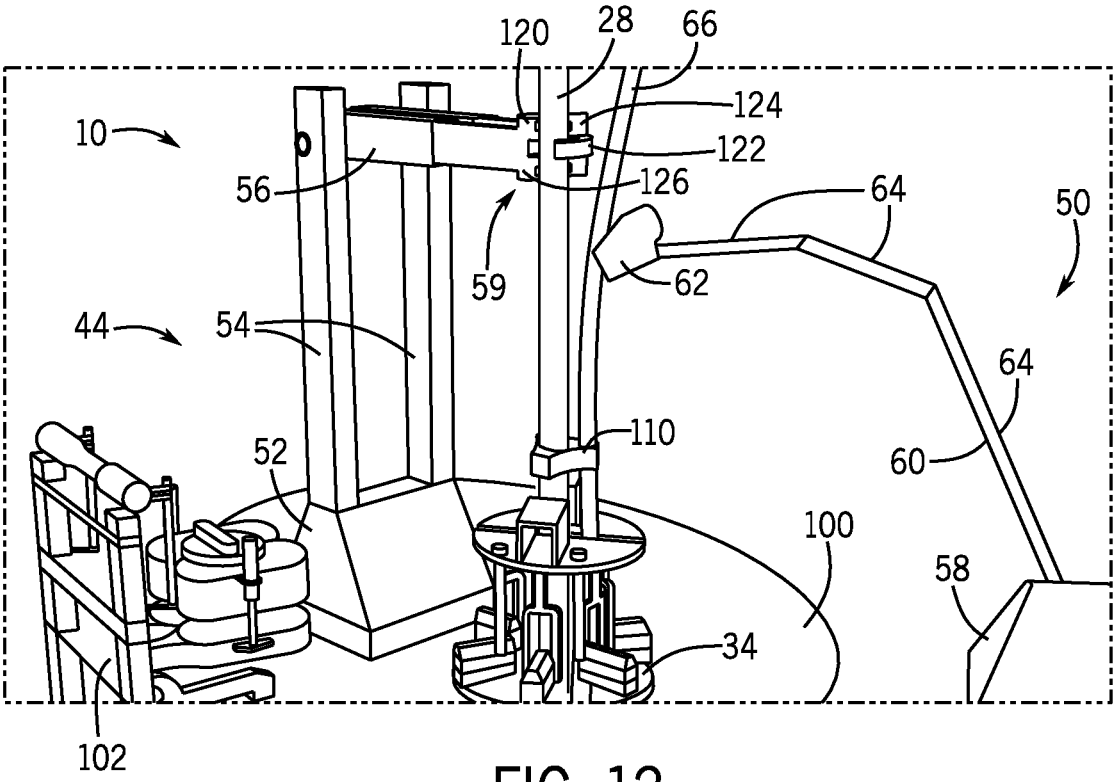
FIG. 12 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.
Figure 13:
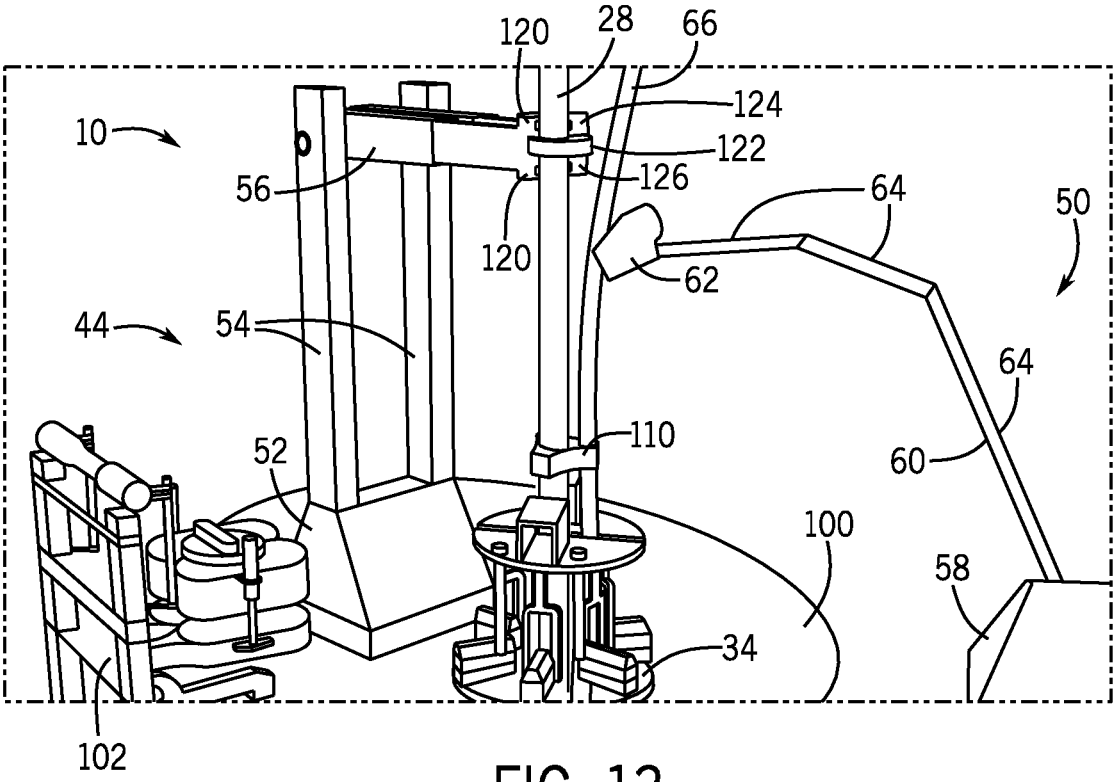
FIG. 13 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.

FIG. 12 is a perspective view of the drilling rig 10, illustrating the drill pipe guide system 44 with the inner ring 122 or arcuate member of the clamp 59 further rotated relative to the outer housing 120. FIG. 13 is a perspective view of the drilling rig 10, illustrating the drill pipe guide system 44 with the clamp 59 fully actuated. In other words, the inner ring 122 or arcuate member of the clamp 59 has rotated relative to the outer housing 120, such that the outer housing 120 and inner ring 122 cooperatively and fully encircle the drill pipe 28. As mentioned above, the clamp 59 (e.g., the outer housing 120 and the inner ring 122) may have an inner diameter that is less than an inner diameter of the passage of the slips 34 or other passage through which the drill string 28 travels as the drill string is lowered. The inner diameter of the clamp 59 is also greater than an outer diameter of the drill string 28. As a result, the clamp 59 limits radial movement of the drill string 28 as the drill string 28 is lowered (e.g., into the wellbore 30 and/or ocean) but also allows axial movement of the drill string 28 through the clamp 59. In certain embodiments, the clamp 59 may include features to enable or facilitate axial movement of the drill string 28 (e.g. movement of the drill string 28 into the wellbore 30 and/or ocean). For example, an inner diameter of the clamp 59 (e.g., the outer housing 120 and/or the inner ring 122) may include bearings (e.g., ball bearings), rollers, or other features to enable or facilitate axial movement of the drill string 28 through the clamp 59.

Figure 14:
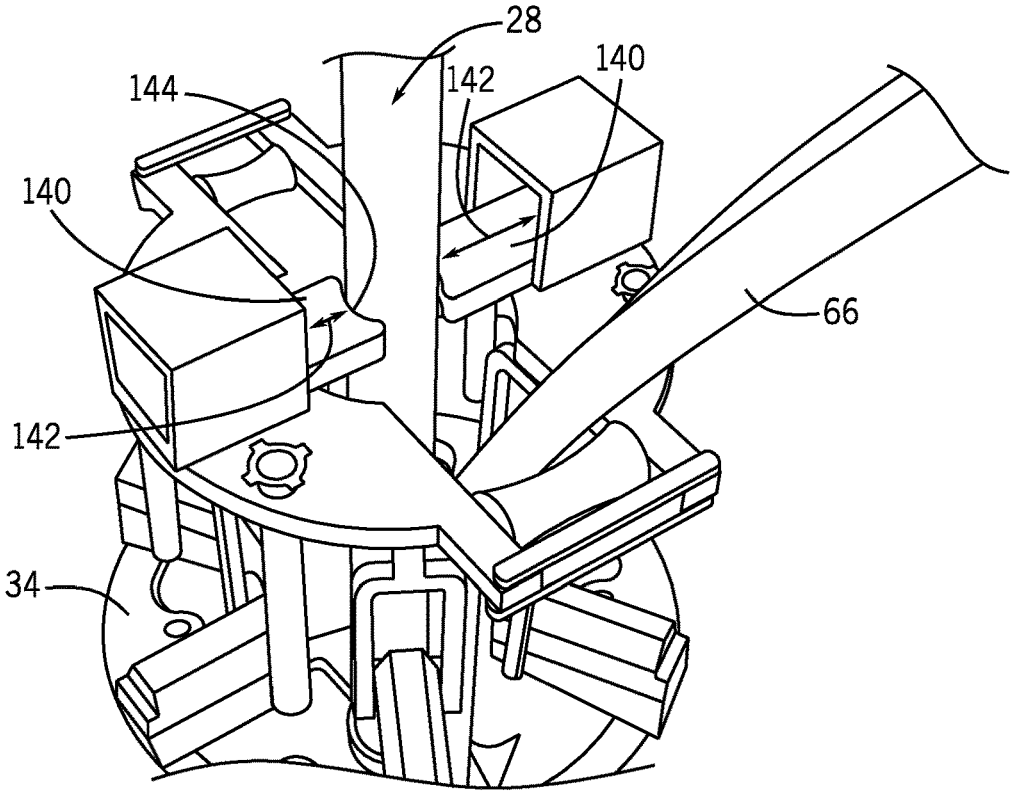
FIG. 14 is a perspective view of an embodiment of a drill pipe guide system and an umbilical guide system for use in assembling and lowering a drill string, illustrating operation of the drill pipe guide system and umbilical guide system, in accordance with an embodiment of the present disclosure.

In certain embodiments, the flush mounted slips 34 may also include guide features to reduce radial movement of the drill string 28 as the drill string 28 is lowered into the wellbore 30 and/or ocean. For example, FIG. 14 is a perspective view of the flush mounted slips 34, illustrating two guide plates 140 positioned opposite one another across the drill string 28. The guide plates 140 may move radially relative to the drill string 28. For example, just before the drill string 28 is lowered into the wellbore 30 and/or ocean, the guide plates 140 may be moved radially inward relative to the drill string 28, as indicated by arrows 142. In this manner, the guide plates 140 (e.g., inner, curved surfaces 144 of the guide plates 140) cooperatively form a reduced inner diameter through which the drill string 28 passes as the drill string 28 is lowered. In this manner, undesired radial movement of the drill string 28 during lowering of the drill string 28 may be reduced. While the illustrated embodiment includes two guide plates 144, other embodiments may include other numbers of guide plates 144, such as 3, 4, 5, 6, 7, 8, or more guide plates 144. Moreover, the guide plates 144 may be spaced equidistantly or generally equidistantly apart from one another about a circumference of the drill string 28.

Figure 15:
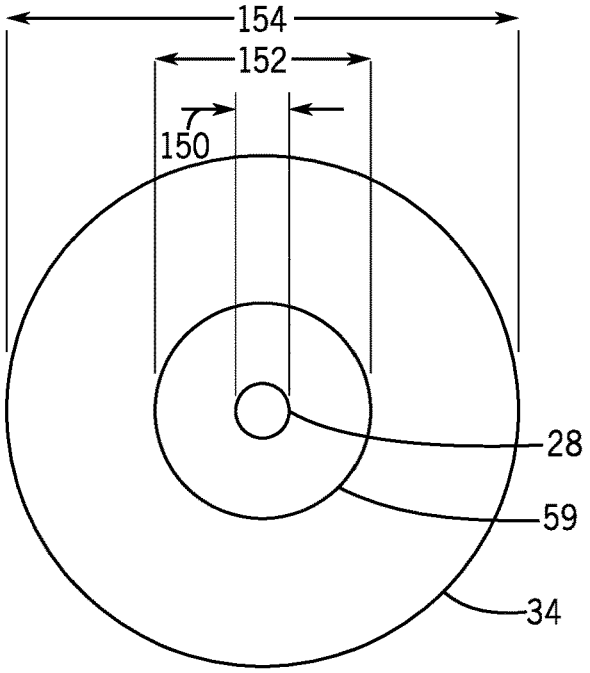
FIG. 15 is a schematic top view of a drill pipe guide system, illustrating a drill string positioned within the drill pipe guide system and a slip system, in accordance with an embodiment of the present disclosure.

FIG. 15 is a schematic top view of the drill string 28, illustrating relative dimensions of the drill string 28, the clamp 59 of the drill pipe guide system 44, and the passageway of the slips 34 or other passage through which the drill string 28 travels as the drill string 28 is lowered in to the wellbore 30 and/or ocean. As shown, the drill string 28 has an outer diameter 150 (e.g., 6⅝"), and the drill pipe guide system 44 (e.g., clamp) has an inner diameter 152 (e.g., 8, 9, or 10") that is smaller than an inner diameter 154 of the slips 34 (e.g., 15, 16, 17, 18, 19, 20" or more) or other passageway through which the drill string 28 passes as the drill string 28 is lowered into the wellbore 30 and/or ocean. It should be noted that the inner diameter 154 of the slips 34 may be sufficiently large to accommodate passage of umbilical clamps 110 through the passageway of the slips 34. Thus, when the clamp 59 is positioned about the drill string 28, the clamp 59 and the drill pipe guide system 44 may limit radial movement of the drill string 28 within the slips 34 or other passageway.

Figure 16:
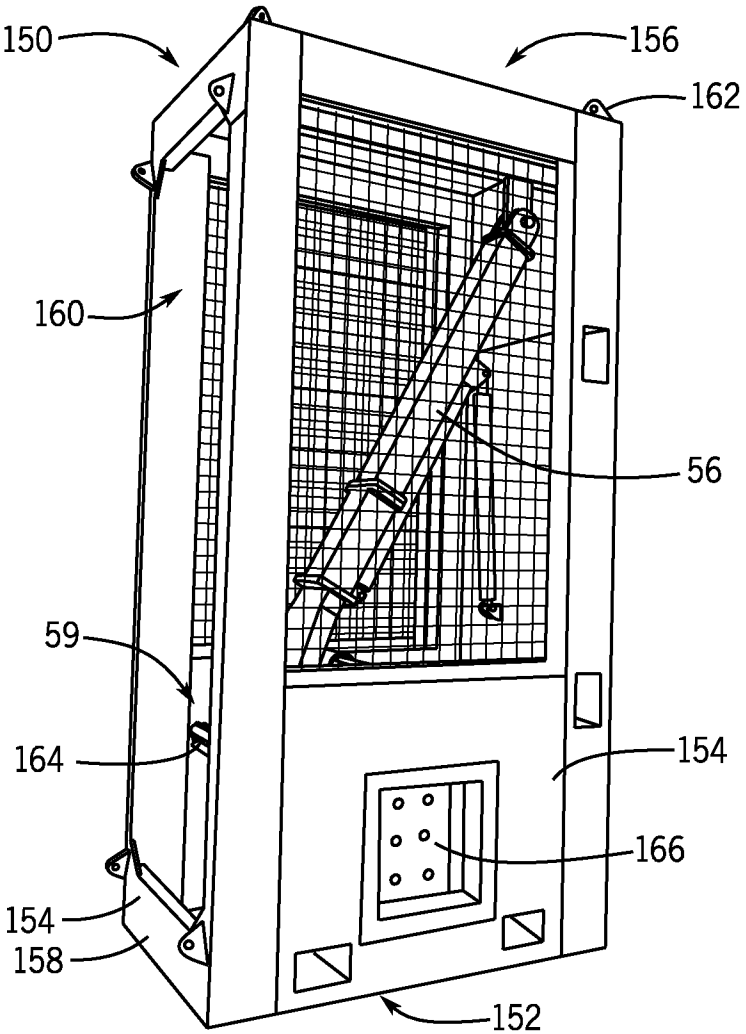
FIG. 16 is a perspective view of a drill pipe guide system, in accordance with an embodiment of the present disclosure.

FIG. 16 is a perspective view of another embodiment of the drill pipe guide system 44. In the illustrated embodiment, the drill pipe guide system 44 includes a self-contained support structure 150, such as a cage, box, or other structure that may support the articulating arm 56. For example, the articulating arm 56 having the clamp 59 may be supported by the support structure 150 (e.g., via a hinge or other pivotable connection. The support structure 150 contains a base 152, a plurality of lateral sides 154, and a top 156 to substantially fully contain the articulating arm 56 and clamp 59 when the articulating arm 56 is in a retracted position. In certain embodiments, one or more portions of the lateral sides 154 and/or the top 156 may have an opening, screen, wire mesh, or other surface to enable an operator to see into the support structure 150.

A front side 158 of the support structure 150 includes an opening 160 through which the articulating arm 56 and clamp 59 may extend (e.g., via pivoting and/or telescoping linkages) when the articulating arm 56 is in a deployed position. As will be appreciated, the box configuration of the support structure 150 may provide additional stability for the drill pipe guide system 44 and/or drill string 28 during operation (e.g., during guiding of the drill pipe 28 into the wellbore 30 and/or ocean) in inclement weather (e.g., when the drill pipe guide system 44 is in use on a drill ship). The top 156 of the support structure 150 also includes a loop, eye, or hook 162 that may be used during transportation of the drill pipe guide structure 44 (e.g., via a crane).

Figure 17:
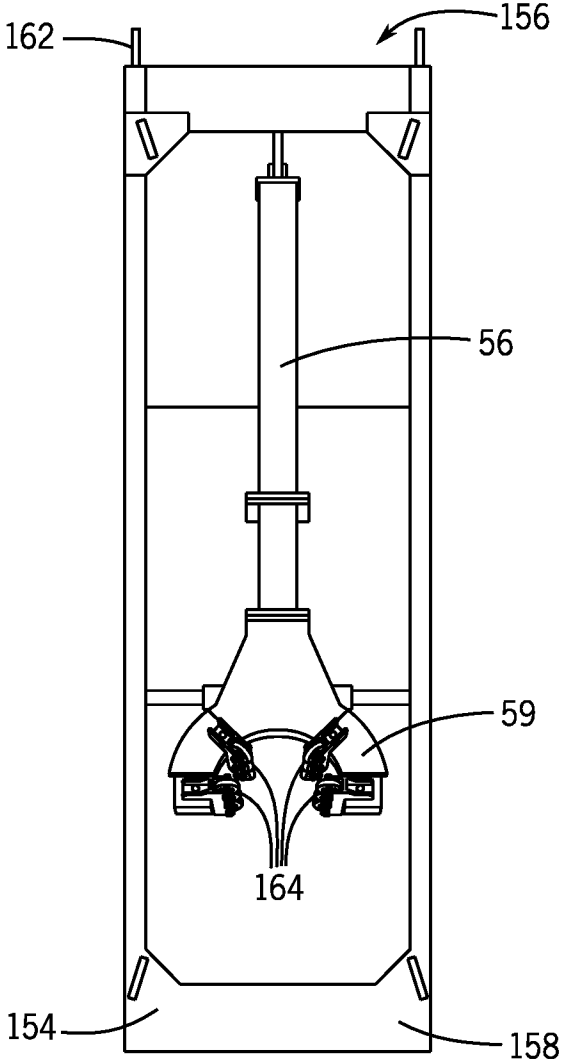
FIG. 17 is a front view of a drill pipe guide system, in accordance with an embodiment of the present disclosure.

FIG. 17 is a front view of the drill pipe guide system 44 having the self-contained support structure 150. In the illustrated embodiment, the articulating arm 56 and the clamp 59 are shown in a partially deployed or extended position. In the deployed or extending position, the articulating arm 56 and clamp 59 extend through the window 160 in the front side 158 of the support structure 150. As with the previously discussed embodiments, the drill pipe guide system 44 having the support structure 150 may be placed adjacent to the slips 34 and drill string 28, such that the deployed articulating arm 56 and clamp 59 may receive and encircle the drill string 28 to limit radial movement of the drill string 28 as the drill string 28 is lowered into the wellbore 30 and/or ocean. In the embodiments shown in FIGS. 16 and 17, the clamp 59 also includes features (e.g., rollers 164) to enable and facilitate axial movement of the drill string 28 through the clamp 59. Additionally, the support structure 150 includes a control panel 166 that may provide connections to couple one or more control features or actuation mechanisms to the drill pipe guide system 44. For example, the control panel 166 may include connections for hydraulics, electronics, communications, or other systems that may be used to operate the drill pipe guide system 44 (e.g., actuation of the articulating arm 56 and/or the clamp 59).

As discussed, present embodiments include the drill pipe guide system 44 (e.g., drill string guide system) that limits movements (e.g., radial movement) of the drill string 28 as tubulars 38 and umbilical cables 66 are added to the drill string 28 and the drill string 28 is lowered into the ocean and/or into the wellbore 30. In particular, the drill pipe guide system 44 is a floor-mounted system (e.g., having the base 52 and/or the self-contained support structure 150) with the articulating arm 56 having the clamp 59 or guide hand. The clamp 59 is positioned about the drill string 28 when the drill pipe guide system 44 is in a deployed position. The inner diameter 152 of the clamp 59 is generally smaller than the inner diameter 154 of the passage of the slips 34 through which the drill string 28 passes as the drill string 28 is lowered. Thus, the clamp 59 limits the movement (e.g., radial movement) of the drill string 28 as umbilical cables 66 are added to the drill string 28 and as the drill string 28 is lowered into the ocean and/or wellbore 30. The floor-mounted configuration of the drill pipe guide system 44 enables modularity and portability of the drill pipe guide system 44. For example, the drill pipe guide system 44 may not require mounting to the derrick 14 or other component of the drilling rig 12 or ship. Additionally, the portability of the floor-mounted drill pipe guide system 44 may enable the drill pipe guide system 44 to be positioned at any location about the circumference of the drill string 28 or slips 34. In other words, the drill pipe guide system 44 may be positioned anywhere on the rig floor 12, thereby increasing convenience and flexibility when using the drill pipe guide system 44.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A drill pipe guide system, comprising:

a support structure configured to be positioned on a rig floor, the support structure being moveable between a first position on the rig floor and a second position on the rig floor, wherein the support structure is configured to move to the second position when a drill string is being lowered into a wellbore, wherein the support structure is configured to move to the first position when a tubular is being added to the drill string; and wherein the second position is closer to a well center than the first position;

an articulating arm coupled to the support structure, wherein the articulating arm is configured to pivot relative to the support structure between a horizontal position and a vertical position; and a clamp coupled to the articulating arm, wherein the clamp is configured to fully encircle the drill string and limit radial movement of the drill string as the drill string is lowered beneath the rig floor, wherein the articulating arm is adapted to remain relatively stationary at all times when the clamp is engaged with one or more tubulars associated with the drill string.

2. The drill pipe guide system of claim 1, wherein the support structure comprises a base and a plurality of support arms extending from the base.

3. The drill pipe system of claim 1, wherein the support structure is configured to be non-rotatable with respect to the rig floor.

4. The drill pipe system of claim 1, wherein the support structure comprises a base, a plurality of lateral sides extending from the base, and a top coupled to the plurality of lateral sides.

5. The drill pipe system of claim 4, wherein the articulating arm is pivotably coupled to at least one of the plurality of lateral sides.

6. The drill pipe system of claim 4, wherein one of the plurality of lateral sides comprises an opening, and wherein the articulating arm and the clamp are configured to extend through the opening when the articulating arm is in a deployed position.

7. The drill pipe system of claim 1, wherein the clamp comprises an outer housing and an inner arc, wherein the inner arc is configured to rotate relative to the outer housing to encircle the drill string.

8. The drill pipe system of claim 7, wherein the outer housing and inner arc cooperatively define an inner diameter when the inner arc is in a deployed position, wherein the inner diameter of the outer housing and inner arc is greater than an outer diameter of the drill string.

9. The drill pipe system of claim 8, wherein the inner diameter of the outer housing and inner arc is less than an inner diameter of slips of a rotary table through which the drill string is lowered.

10. The drill pipe system of claim 1, comprising an umbilical guide system configured to guide an umbilical cable against the drill string, wherein the umbilical guide system comprises a base, an extension arm extending from the base, and a guide bracket disposed at a distal end of the extension arm, wherein the extension arm comprises a plurality of side flanges configured to capture the umbilical cable and guide the umbilical cable against the drill string.

11. A method, comprising:

moving a support structure of a drill pipe guide system to a first location on a rig floor;

coupling a first tubular to a drill string to be run into a wellbore with a tubular rotation system;

moving a support structure of the drill pipe guide system to a second location on the rig floor, with an articulating arm coupled to the support structure, wherein the second location is closer to a well center on the rig floor than the first location;

positioning an umbilical cable against the drill string with an umbilical guide system;

pivoting the articulating arm relative to the support structure from a vertical position to a horizontal position;

encircling the drill string with a clamp coupled to the articulating arm of the drill pipe guide system, wherein the articulating arm is adapted to remain relatively stationary at all times when the clamp is engaged with one or more tubulars associated with the drill string;

running the drill string through slips in a drilling rig floor, wherein the clamp of the drill pipe guide system comprises an inner diameter that is less than an inner diameter of the slips in the drilling rig floors; and moving the support structure to a third location prior to coupling a second tubular to the drill string, wherein the third location is farther away from the well center than the second location.

12. The method of claim 11, comprising extending the articulating arm of the drill pipe guide system from a retracted position to an extended position before encircling the drill string with the clamp of the drill pipe guide system.

13. The method of claim 11, wherein encircling the drill string with the clamp of the drill pipe guide system comprises rotating an inner arc of the clamp relative to an outer housing of the clamp after extending the articulating arm of the drill pipe guide system from a retracted position to an extended position.

14. The method of claim 11, comprising clamping the umbilical cable to the drill string with a cable clamp, wherein an outer diameter of the cable clamp is greater than the inner diameter of the clamp of the drill pipe guide system and less than the inner diameter of the slips in the drilling rig floor.

15. The method of claim 11, comprising facilitating passage of the drill string through the clamp of the drill pipe guide system with a plurality of rollers disposed on the inner diameter of the clamp.

16. A system, comprising:

a support structure configured to be positioned on a drillship floor, the support structure being moveable between a first position on the drillship floor and a second position on the drillship floor, wherein the support structure comprises a base, and a plurality of lateral sides extending from the base, wherein the support structure is configured to move to the second position when a tubular string is being lowered into a wellbore, wherein the support structure is configured to move to the first position when a tubular segment is being added to the tubular string; and wherein the second position is closer to a well center than the first position;

an articulating arm coupled to the support structure, wherein the articulating arm is configured to pivot relative to the support structure, and wherein the articulating arm is rotatable only about a horizontal axis; and a clamp disposed at a distal end of the articulating arm, wherein the clamp is configured to encircle a drill string and limit radial movement of the drill string as the drill string is lowered beneath the drillship floor, and wherein the articulating arm is adapted to remain relatively stationary at all times when the clamp is engaged with one or more tubulars associated with the drill string.

17. The system of claim 16, wherein the clamp comprises a plurality of rollers disposed on an inner diameter of the clamp, wherein the plurality of rollers is configured to enable axial translation of the drill string through the clamp.

18. The system of claim 16, wherein the clamp comprises an outer housing and at least one inner arc disposed within the outer housing, wherein the at least one inner arc is configured to rotate relative to the outer housing to at least partially encircle the drill string.

19. The system of claim 16, wherein the articulating arm is coupled to one of the plurality of lateral sides of the support structure.

20. The system of claim 16, comprising the drillship floor, wherein the drillship floor comprises flush mounted slips through which the drill string is lowered, wherein the flush mounted slips comprise an inner diameter, wherein an inner diameter of the clamp is less than the inner diameter of the flush mounted slips.

* * * * *